US008331824B2

(12) United States Patent
Choi et al.

(10) Patent No.: US 8,331,824 B2
(45) Date of Patent: Dec. 11, 2012

(54) HEATING MEMBER HAVING RESISTIVE HEATING LAYER AND FUSING DEVICE USING THE SAME

(75) Inventors: Jin-Seung Choi, Suwon-si (KR); Seung-Jin Oh, Seoul (KR); Young-Chul Ko, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 249 days.

(21) Appl. No.: 12/782,169

(22) Filed: May 18, 2010

(65) Prior Publication Data

US 2011/0013955 A1 Jan. 20, 2011

(30) Foreign Application Priority Data

Jul. 14, 2009 (KR) ..... 10-2009-0064086

(51) Int. Cl.
*G03G 15/20* (2006.01)

(52) U.S. Cl. ..... 399/92; 399/333

(58) Field of Classification Search ..... 399/328, 399/330, 333, 92
See application file for complete search history.

(56) References Cited

FOREIGN PATENT DOCUMENTS

JP 05-289568 11/1993

OTHER PUBLICATIONS

English language abstract of JP 05-289568, published Nov. 5, 1993.
Machine English language translation of JP 05-289568, published Nov. 5, 1993.

*Primary Examiner* — Hoang Ngo
(74) *Attorney, Agent, or Firm* — Staas & Halsey LLP

(57) ABSTRACT

Disclosed are a heating member having a resistive heating layer and a fusing device using the heating member. The heating member includes the resistive heating layer on an outer circumferential surface of a load support member. Electricity is supplied to an inner circumferential surface and an outer circumferential surface of the resistive heating layer in a direction perpendicular to the resistive heating layer.

20 Claims, 11 Drawing Sheets

HEATING MEMBER HAVING RESISTIVE HEATING LAYER AND FUSING DEVICE USING THE SAME

CROSS-REFERENCE TO RELATED PATENT APPLICATION

This application claims the benefit of Korean Patent Application No. 10-2009-0064086, filed on Jul. 14, 2009, in the Korean Intellectual Property Office, the disclosure of which is incorporated herein by reference in its entirety.

TECHNICAL FIELD

The present disclosure relates to a heating member having a resistive heating layer, and to a fusing device that fuses toner on paper using the heating member.

BACKGROUND OF RELATED ART

In an electrophotographic image forming apparatus, toner is provided to an electrostatic latent image formed on an image receiving medium, to form a visible toner image. The toner image is transferred from the image receiving medium to sheet of paper, which transferred toner image is then fused onto the sheet of paper. The toner is manufactured by adding various functional additives, including, for example, a coloring agent, to base resin. In the fusing process, toner is permanently fused onto a printing medium such as, for example, sheet of paper, mainly by the application of heat and pressure. A considerable portion of energy used in the electrophotographic image forming apparatus is consumed during the fusing process.

Conventially, a fusing device employs a fixing nip formed between a heating belt that generates heat and a pressing roller, or between a heating roller and a pressing roller engaged with each other. While the paper, to which the toner is transferred, passes through the fixing nip, heat and pressure are applied to the toner. The heat may be generated by heating a heating belt or a heating roller with a radiant heat source such as, for example, a halogen lamp, disposed in the fusing device, locally by attaching a resistive heating member such as, for example, a ceramic heater adhered near the fixing nip, or on the entire surface of a heating belt or heating roller by forming a resistive heating member on the surface of the heating belt or the heating roller.

SUMMARY OF DISCLOSURE

An aspect of the present disclosure provides a heating member capable of reducing an electrical resistance of a resistive heating layer and a fusing device using the heating member.

According to an aspect of the present disclosure, there is provided a heating member that may include a load support member, a resistive heating layer formed on the outer circumferential surface of the load support member and an outer electrode layer formed on an outer circumferential surface of the resistive heating layer. The load support member may have an outer circumferential surface that is conductive. The resistive heating layer may be capable of producing heat in response to a conduction of electricity therethrough. When the electricity is supplied through the load support member and the outer electrode layer, the electricity may flow in the resistive heating layer in a radial direction thereof.

The load support member may comprise a non-conductive support member and an inner electrode layer formed on an outer circumferential surface of the non-conductive support member. The non-conductive support member may be formed of a non-conductive material. The inner electrode layer may be formed of conductive material.

The inner electrode layer may comprise at least one selected from the group consisting of a metal, a conductive metal oxide, a conductive polymer and a conductive carbonaceous material.

The inner electrode layer may have a thickness of 500 nm or greater.

The resistive heating layer may comprise a base material and a conductive filler dispersed in the base material.

The base material may comprise an elastic material.

The elastic material may comprise silicon rubber.

The amount of conductive filler dispersed in the based material may be 20 wt % or less.

The conductive filler may comprise at least one of a metallic filler and a carbonaceous filler.

The outer electrode layer may comprise at least one selected from the group consisting of a metal, a conductive metal oxide, a conductive polymer and a conductive carbonaceous material.

The outer electrode layer may have a thickness of 500 nm or greater.

The heating member may further comprise an elastic layer interposed between the outer electrode layer and an outermost layer of the heating member or between the load support member and the resistive heating layer.

The heating member may further comprise a release layer formed on an outer circumferential surface of the outer electrode layer.

According to another aspect of the present disclosure, a fusing device may be provided for fusing toner onto a print medium by application of heat and pressure on the print medium. The fusing device may comprise a heating member for producing heat and a press member in a pressing contact with the heating member so as to form a fixing nip with the heating member. The heating member may comprise a load support member, a resistive heating layer formed on the outer circumferential surface of the load support member and an outer electrode layer formed on an outer circumferential surface of the resistive heating layer. The load support member may have an outer circumferential surface that is conductive. The resistive heating layer may be capable of producing heat in response to a conduction of electricity therethrough. When the electricity is supplied through the load support member and the outer electrode layer, the electricity may conduct in the resistive heating layer in a direction perpendicular to the resistive heating layer.

The heating member may have a roller shape.

The heating member may have a belt shape.

The fusing device may further comprise a pressing member disposed inside the heating member. The pressing member may press at least a portion of the heating member toward the press member.

According to yet another aspect of the present disclosure, a fusing device may be provided for fusing toner onto a print medium by application of heat and pressure on the print medium. The fusing device may comprise a heating member for producing heat, a nip forming member arranged to be spaced apart from the heating member, a fixing belt and a pressing member. The fixing belt may form a closed loop around, and in contact with each of, the heating member and the nip forming member so as to convey the heat produced by the heating member to the nip forming member. The pressing member may opposingly face the nip forming member with the fixing belt interposed between the nip forming member and the pressing member. The pressing member may press the fixing belt against the nip forming member so as to cause a fixing nip to be formed between the nip forming member and the fixing belt. The heating member may comprise a load support member, a resistive heating layer formed on the outer circumferential surface of the load support member and an outer electrode layer formed on an outer circumferential surface of the resistive heating layer. The load support member may have an outer circumferential surface that is conductive. The resistive heating layer may be capable of producing heat in response to a conduction of electricity therethrough. When the electricity is supplied through the load support member and the outer electrode layer, the electricity may conduct in the resistive heating layer in a direction perpendicular to the resistive heating layer.

The resistive heating layer may comprise a base material and a conductive filler dispersed in the base material. The amount of conductive filler dispersed in the based material may be 20 wt % or less.

The outer electrode layer may have a thickness of 500 nm or greater.

BRIEF DESCRIPTION OF THE DRAWINGS

Various features and advantages of the present disclosure will become more apparent from the following description in detail of several embodiments thereof with reference to the attached drawings, in which.

DETAILED DESCRIPTION OF SEVERAL EMBODIMENTS

Figure 1:
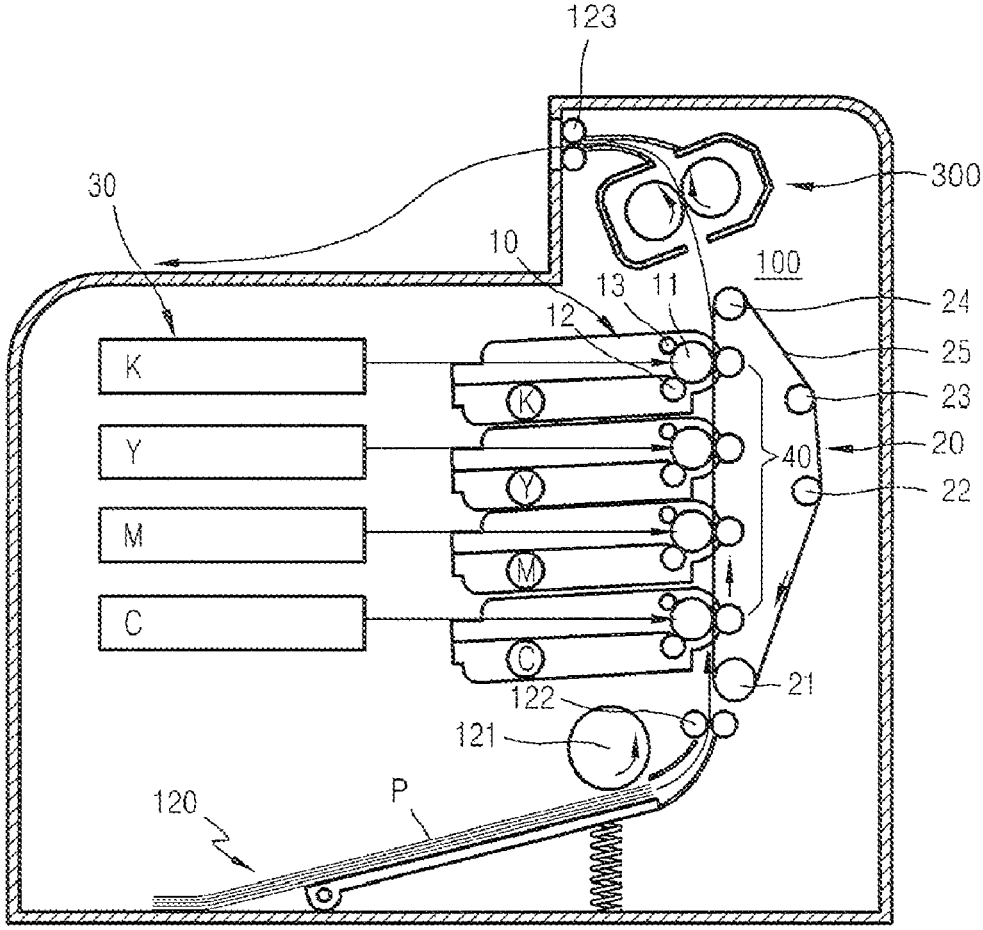
FIG. 1 illustrates an electrophotographic image forming apparatus according to an embodiment of the present disclosure.

Aspects of the present disclosure will now be described more fully with reference to the accompanying drawings, in which several embodiments of the present disclosure are illustrated. In the accompanying drawings, like reference numerals refer to like elements throughout, repetitive descriptions of which may be omitted. It should be also noted that in the drawings, the dimensions of the features are not intended to be to true scale and may be exaggerated for the sake of allowing greater understanding. While several embodiments are described with particular details in order to allow a full and comprehensive understanding of the aspects of the present disclosure, and to fully enable those skilled in the art to practice the same, it should be understood, however, that many modifications and variations are possible to the embodiments shown and described herein, and that the full scope of the present disclosure should not be construed as being limited by those embodiments described herein.

FIG. 1 illustrates an electrophotographic image forming apparatus employing a heating member and a fusing device according to an embodiment of the present disclosure. Referring to FIG. 1, the electrophotographic image forming apparatus according to an embodiment may include a printing unit 100 for printing an image on a sheet of paper by an electrophotographic process and a fusing device 300. As an illustrative example, shown in FIG. 1 is a dry electrophotographic image forming apparatus that prints a color image using dry developer (hereinafter, referred to as the toner).

The printing unit 100 may include an exposure unit 30, a developing unit 10, and a transfer unit 20. To print a color image, the printing unit 100 according to an embodiment as illustrated in FIG. 1 may include four developing units 10C, 10M, 10Y and 10K, respectively, containing toner of different colors, for example, cyan (C), magenta (M), yellow (Y) and black (K), and four exposing units 30C, 30M, 30Y and 30K, respectively, corresponding to the developing units 10C, 10M, 10Y and 10K.

Each of the developing units 10C, 10M, 10Y and 10K may include a photosensitive drum 11 that is an example of an image receiving medium on which an electrostatic latent image is formed, a developing roller 12 for developing the electrostatic latent image and a charge roller 13 to which a charge bias is applied to charge the outer circumference of the photosensitive drum 11 to a uniform electric potential. In some alternative embodiments, a corona discharger (not shown) may be used instead of the charge roller 13. The developing roller 12 having toner adhered to its outer circumference supplies the toner to the photosensitive drum 11. A development bias is applied to the developing roller 12 to aid in the supply of toner to the photosensitive drum 11. Although not illustrated in the drawings, each of the developing units 10C, 10M, 10Y and 10K may further include a supply roller (not shown) supplying the toner contained in each of the developing units 10C, 10M, 10Y and 10K to the associated developing roller 12, a regulation member (not shown) regulating the amount of toner adhering to the developing roller 12 and an agitator (not shown) transferring the toner contained in each of the developing units 10C, 10M, 10Y and 10K to the supply roller and/or the developing roller 12. Also, although not illustrated in the drawings, each of the developing units 10C, 10M, 10Y and 10K may further include a cleaning blade for removing the toner remaining residual from previous image forming, operation on the outer circumference of the photosensitive drum 11 prior to the charging of the photosensitive drum 11 and an accommodation space for accommodating the removed toner.

According to an embodiment, the transfer unit 20 may include a paper transfer belt 25 and four transfer rollers 40. The paper transfer belt 25 may be arranged to face the outer circumferential surface of the photosensitive drum 11 that is exposed to the outside of the developing units 10C, 10M, 10Y and 10K. The paper transfer belt 25 circulates while being supported by a plurality of support rollers 21, 22, 23 and 24. Each of the transfer rollers 40 may be arranged to opposingly face the photosensitive drum 11 of respective one of the developing units 10C, 10M, 10Y and 10K, with the paper transfer belt 25 interposed therebetween. A transfer bias may be applied to each of the transfer rollers 40. Each of the exposing units 30C, 30M, 30Y and 30K may scan a light beam corresponding to image information of cyan (C), magenta (M), yellow (Y) and black (K) onto the photosensitive drum 11 of the respective corresponding one of the developing units 10C, 10M, 10Y and 10K. In the electrophotographic image forming apparatus according to an embodiment of the present disclosure, a laser scanning unit (LSU) using a laser diode as a light source, for example, may be employed as any of the exposing units 30C, 30M, 30Y and 30K.

A color image forming process by the electrophotographic image forming apparatus configured as above will now be described in greater detail.

The photosensitive drum 11 of each of the developing units 10C, 10M, 10Y and 10K is charged to a uniform electric potential by the charge bias applied to the charge roller 13. Each of the exposing units 30C, 30M, 30Y and 30K scans a light beam corresponding to the image information of cyan (C), magenta (M), yellow (Y) and black (K) onto the photosensitive drum 11 of each of the developing units 10C, 10M, 10Y and 10K, thereby forming an electrostatic latent image on the photosensitive drum 11. With a development bias applied to the developing roller 12, the toner from the outer circumference of the developing roller 12 move and adheres to the electrostatic latent image on the photosensitive drum 11 so that toner images of cyan (C), magenta (M), yellow (Y) and black (K) may be respectively formed on the photosensitive drums 11 of the developing units 10C, 10M, 10Y and 10K.

A medium that finally receives the toner, for example, a sheet of paper P, is drawn from a cassette 120 by a pickup roller 121. The paper P is transferred to the paper transfer belt 25 by a transfer roller 122. The paper P is carried on the surface of the paper transfer belt 25 due to an electrostatic force, and is transferred at the same velocity as the linear velocity of the paper transfer belt 25.

For example, the leading end of the paper P arrives at the transfer nip formed between the transfer roller 40 and the photosensitive drum 11 of the developing unit 10C in synchronization with the arrival of the leading end of a toner image of cyan (C) formed on the outer circumferential surface of the photosensitive drum 11 of the developing unit 10C at the transfer nip of the corresponding transfer roller 40. When the transfer bias is applied to the corresponding transfer roller 40, the toner image formed on the photosensitive drum 11 is transferred to the paper P. As the paper P continues to be carried by the paper transfer belt 25 toward the remaining photosensitive drums 11, the toner images of magenta (M), yellow (Y) and black (K) formed respectively on the photosensitive drums 11 of the developing units 10M, 10Y and 10K are sequentially transferred to the paper P to overlap with one another. Accordingly, a color toner image, that is, a superimposed combination of the individual color images, is formed on the paper P.

The color toner image transferred to the paper P is maintained on the surface of the paper P due to an electrostatic force. The fusing device 300 fuses the color toner image on the paper P using heat and pressure. The paper P that has undergone the fusing process is ejected out of the electrophotographic image forming apparatus by ejection rollers 123, thus completing the color image forming process.

Figure 2:
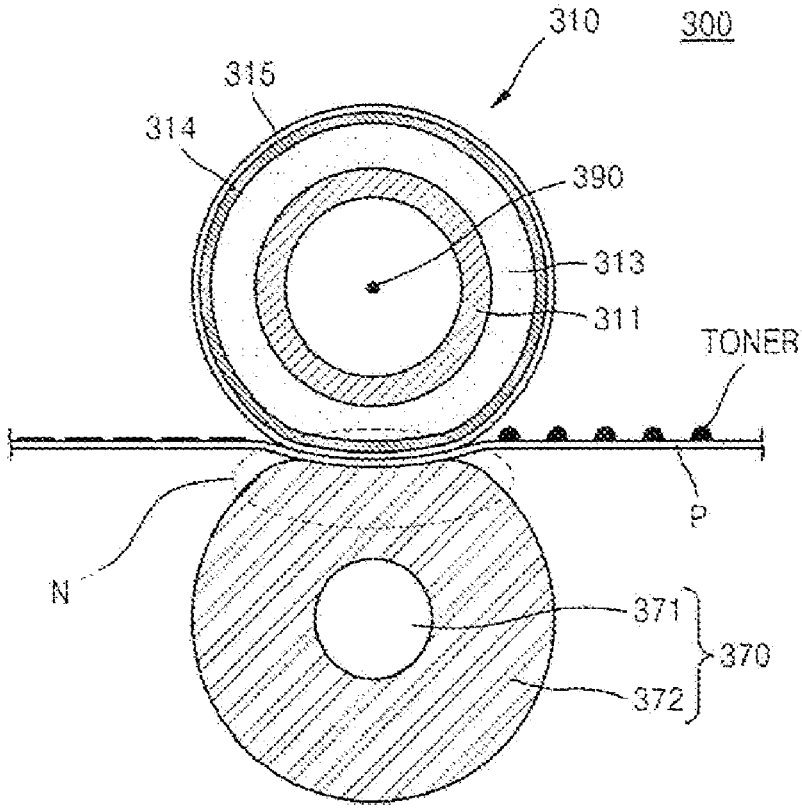
FIG. 2 is a cross-sectional view of a heating member of the fusing device according to an embodiment of the present disclosure that can be employed in the electrophotographic image forming apparatus of FIG. 1.

FIG. 2 is a cross-sectional view of a heating member of the fusing device 300 according to an embodiment of the present disclosure that may be employed in the electrophotographic image forming apparatus of FIG. 1. Referring to FIG. 2, the fusing device 300 according to an embodiment may include a heating member 310 of a roller shape that is rotatable around a rotation axis 390 and a press member 370 engaged with the heating member 310 to form a fixing nip N. For example, the pressing member 370 may have a roller shape, and may include a metallic core 371 and an elastic layer 372 formed on the metallic core 371. The heating member 310 and the press member 370 may be elastically biased toward each other by a bias member, for example, a spring (not shown). The elastic layer 372 of the press member 370 may become partially deformed to thereby form the fixing nip N, at which the thermal transfer from the heating member 310 to the toner on the paper P is made.

The heating member 310 may include a load support member 311, a resistive heating layer 313 formed on the outer circumference of the load support member 311 and an outer electrode layer 314 for supplying electricity to the resistive heating layer 313.

The load support member 311 maintains the external appearance of the heating member 310, and may also act as the rotation axis for the heating member 310. According to an embodiment, the load support member 311 may be formed of a conductive material to function as an inner electrode of the resistive heating layer 313. For example, the load support member 311 may be a metal pipe formed of iron (Fe), steel, stainless steel, aluminum (Al), copper (Cu), or the like.

A release layer 315, which is the outermost layer of the heating member 310, is used to prevent an offset, i.e., prevent the toner of the paper P from being transferred to the surface of the heating member 310. The release layer 315 may be formed of a fluoropolymer such as, for example, tetrafluoroethylene/perfluoroalkylvinyl ether copolymer (PFA), polytetrafluorethylene (PTFE), tetrafluoroethylene/hexafluoropropylene copolymer (FEP), or the like. In some embodiments, the release layer 315 may not be necessary, and may thus be omitted.

The resistive heating layer 313 of the heating member 310 may functions as a surface heating source of the fusing device 300. To that end, the resistive heating layer 313 may be fabricated by dispersing a conductive filler in a base material. When an elastic base material is used, the resistive heating layer 313 may also function as an elastic layer. For example, a highly heat-resistant elastomer such as silicon rubber, for example, polydimethyl siloxane (PDMS), may be used as the base material. As such, if the resistive heating layer 313 functions as an elastic layer, it may not be necessary to provide another elastic layer in the heating member 310, allowing a simpler configuration of the heating member 310. When power is supplied to the resistive heating layer 313, Joule heat is generated. The conductive filler may include a metallic filler such as, for example, iron (Fe), nickel (Ni), aluminum (Al), gold (Au), and/or silver (Ag), and/or a carbonaceous filler such as, for example, carbon black, single carbon fiber, carbon filament, and/or carbon coil. The metallic filler may have various shapes such as acicular, planar and circular. In order to increase thermal conductivity, the resistive heating layer 313 may further include a metal oxide such as, for example, alumina, an iron oxide, or the like.

To fix an image on the paper P, the fusing device 300 is heated to a temperature close to the predetermined fusing temperature. As the time for heating the fusing device 300 decreases, the time for printing the first page after a print command is received decreases as well. Thus, while it is possible to heat the fusing device 300 only when printing is carried out, reheat the fusing device 300 to restart the printing may take some time. To reduce the time required to restart the printing, the fusing device 300 is controlled to maintain its temperature constant during the ready mode, at which mode the image forming apparatus stands ready to perform a printing operation. A preheat temperature in the ready mode may be, for example, in the range of 150 to 180° C. In order for an image forming apparatus to print an image on an A4 size paper, the amount of power consumption may be, for example, about 30 watts. By sufficiently reducing the heat-up time required in order to increase the temperature of the fusing device 300 to the temperature at which printing may be performed to such an extent that the preheating during the ready mode may become unnecessary, the energy consumption by the fusing device 300 can also be reduced.

The heating temperature and heating rate of the resistive heating layer 313 depend on the geometrical dimensions of the resistive heating layer 313 such as, for example, the thickness and the length of the resistive heating layer 313, as well as on the physical properties of the resistive heating layer 313 such as, for example, specific heat and electrical conductivity. According to an embodiment, the power supply (not shown) for supplying the electricity to the fusing device 300 may be a power source supplying a constant voltage, in which case, as the resistance of the resistive heating layer 313 decreases, the heating member 310 can be heated more efficiently and quickly. Generally speaking, the resistance R of the resistive material is proportional to its length, and is inversely proportional to the size of the cross-section area and to the electrical conductivity of the resistive material. In order to reduce the resistance of the resistive heating layer 313, the electrical conductivity of the resistive heating layer 313 may be increased. The electrical conductivity of the resistive heating layer 313 may be increased by increasing the amount of conductive filler, by improving the alignment of conductive filler and by controlling the dispersity of the conductive filler. However, the increase in the amount of conductive filler may influence the hardness or tensile force of the resistive heating layer 313, which may adversely impact the fusing properties of the toner image. In addition, as the amount of conductive filler increases, the conductive filler may aggregate in the base material so that the heating may not be uniform. The use of a large amount of an expensive conductive filler may not be desirable from the standpoint of manufacturing costs. Furthermore, the increase in the amount of conductive filler may result in a deterioration of the mechanical properties of the heating member 310, resulting in a reduction in the useful life of the heating member 310. Thus, the extent in which the amount of conductive filler can be increased may be limited. Even though the electrical conductivity of the resistive heating layer 313 may be increased by improving the alignment of the conductive filler and/or by controlling the dispersity of the conductive filler, without also increasing the amount of conductive filler, it may be difficult to sufficiently increase the electrical conductivity of the resistive heating layer 313.

Figure 3:
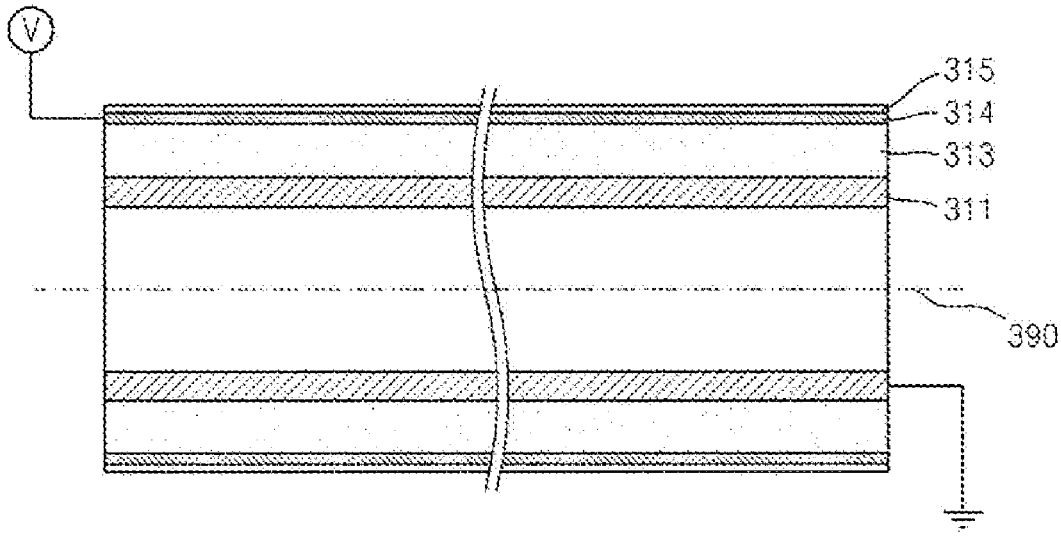
FIG. 3 is a longitudinal cross-sectional view of the heating member of the fusing device of FIG. 2.
Figure 4:
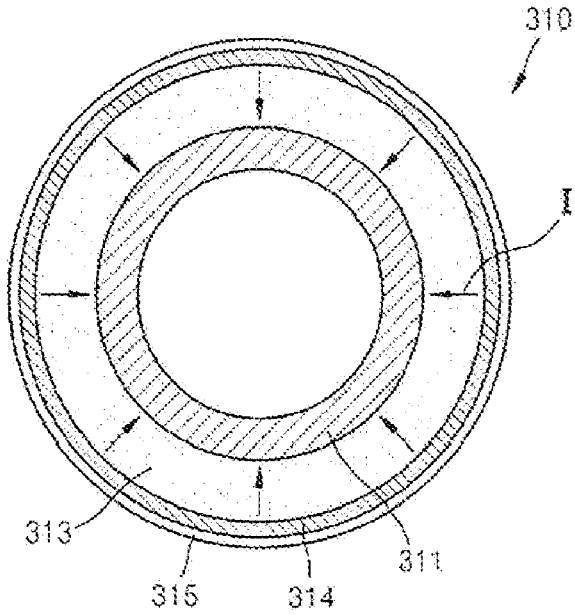
FIG. 4 illustrates the flow of current in the resistive heating layer of the fusing device of FIG. 2.

According to an embodiment of the present disclosure, the length of the resistive material, i.e., the length of the current path of the resistive heating layer 313, may be reduced. That is, by applying a voltage to the inner circumference and the outer circumference of the resistive heating layer 313, the current is allowed to flow in a radial direction of the resistive heating layer 313. To that end, as shown in FIGS. 2 and 3, the load support member 311 may be used as the inner electrode of the resistive heating layer 313 while the outer electrode layer 314 may be formed on the outer circumferential surface of the resistive heating layer 311. As illustrated in FIGS. 3 and 4, if a voltage V is applied to the load support member 311 and the outer electrode layer 314, the current flows in the radial direction of the resistive heating layer 313. The radial direction of the resistive heating layer 313 is a direction perpendicular to the resistive heating layer 313. For descriptive convenience, the outer electrode layer 314 is considered to be the anode while the load support member 311 is considered to be the cathode.

With the above described configuration of the heating member 310, a more efficient and quicker heating can be realized, even without a significant increase in the amount of conductive filler being used, by reducing the resistance of the resistive heating layer 313, since current flows in the radial direction of the resistive heating layer 313. Thus, it may be possible to achieve the desirable heating properties of the resistive heating layer 313 while allowing the amount of conductive filler added to the resistive heating layer 313 to be controlled for example, to be about 20 wt % or less, so as to provide suitable mechanical properties such as hardness, tensile force, and compressive strength of the resistive heating layer 313 of the fusing device 300. It may also be possible to maintain the amount of conductive filler in a range in which the mechanical properties of the resistive heating layer 313 are suitable for a common manufacturing process such as, for example, injection, extrusion and spray coating, without resulting in an unsuitable heating properties of the resistive heating layer 313.

For example, if electrodes are installed respectively on the inner circumferential surface and the outer circumferential surface of the resistive heating layer 313 so that the current flows in the radial direction of the resistive heating layer 313 that has a length of 230 mm, a thickness of 0.25 mm and a diameter of 24 mm, the resistive heating layer 313 may have a low resistance of about 37.3Ω at a common input power of 1300 W and voltage of 220 V despite of a low electrical conductivity of $4\times10^{-4}$ S/m, which electrical conductivity may be obtained even when the amount of conductive filler in the resistive heating layer 313 is, for example, 20 wt % or less.

The outer electrode layer 314 is formed on the outer circumferential surface of the resistive heating layer 313 to supply electricity to the resistive heating layer 313. The electricity may be supplied uniformly to the entire outer circumferential surface of the resistive heating layer 313 so as to uniformly heat the resistive heating layer 313 for uniform fusing of the toner. According to an embodiment, the outer electrode layer 314 may have a thickness of 500 nm or greater so that electricity is uniformly supplied to the entire outer circumferential surface of the resistive heating layer 313. According to an embodiment, the outer electrode layer 314 may be formed of metal having high electrical conductivity such as, for example, without limitation, Au, Al, Cu and Ni. Alternatively, the material that is used to form the outer electrode layer 314 may be: a conductive metal oxide such as, for example, without limitation, indium tin oxide (ITO) commonly used to form a transparent electrode; a conductive polymer with excellent electrical conductivity such as, for example, poly-3,4-ethylenedioxythiophene (PEDOT) and polypyrrole (PPy); a carbonaceous material such as, for example, carbon fiber, carbon nanotube, carbon nanofiber, carbon filament, carbon coil, and carbon black; and any composite material thereof.

Figure 5:
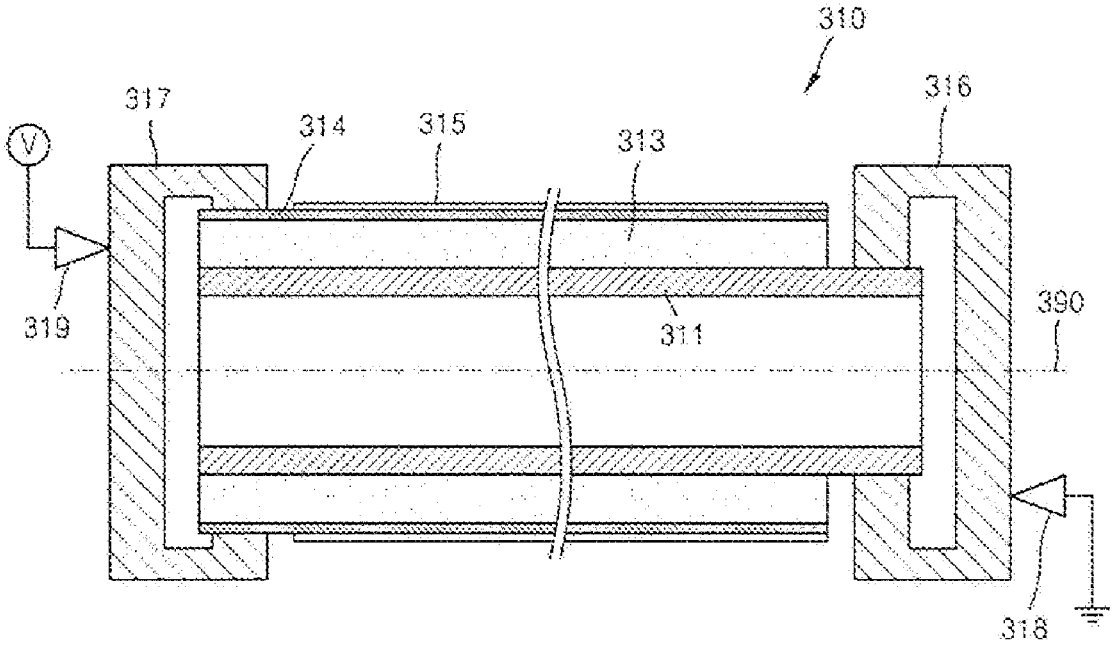
FIG. 5 is a longitudinal cross-sectional view of the heating member of the fusing device of FIG. 2 for purposes of illustrating the connection of power between the resistive heating layer and the power supply unit.

FIG. 5 is a longitudinal cross-sectional view of the heating member 310 of the fusing device 300 of FIG. 2 for purposes of illustrating an example of the supply of the electrical power to the load support member 311 and to the outer electrode layer 314. Referring to FIG. 5, a portion of the outer electrode layer 314 may be exposed at one end of the heating member 310 while a portion of the load support member 311 may be exposed at the other end of the heating member 310. A first connector 316 is connected to the exposed portion of the load support member 311. A first brush 318 is biased by a bias member (not shown) such as, for example, a spring to, so that the first brush 318 makes contact the first connector 316. A second connector 317 may be connected to the exposed portion of the outer electrode layer 314, and may be in contact with a second brush 319 that may be biased to contact the second connector 317. The first and second connectors 316 and 317 and the first and second brushes 318 and 319 may be formed of highly conductive metal. The above described electrical connections to the load support member 311 and the outer electrode layer 314 to a power supply (not shown) is merely illustrative examples, and should not be construed to limit the scope of the present disclosure.

Figure 6:
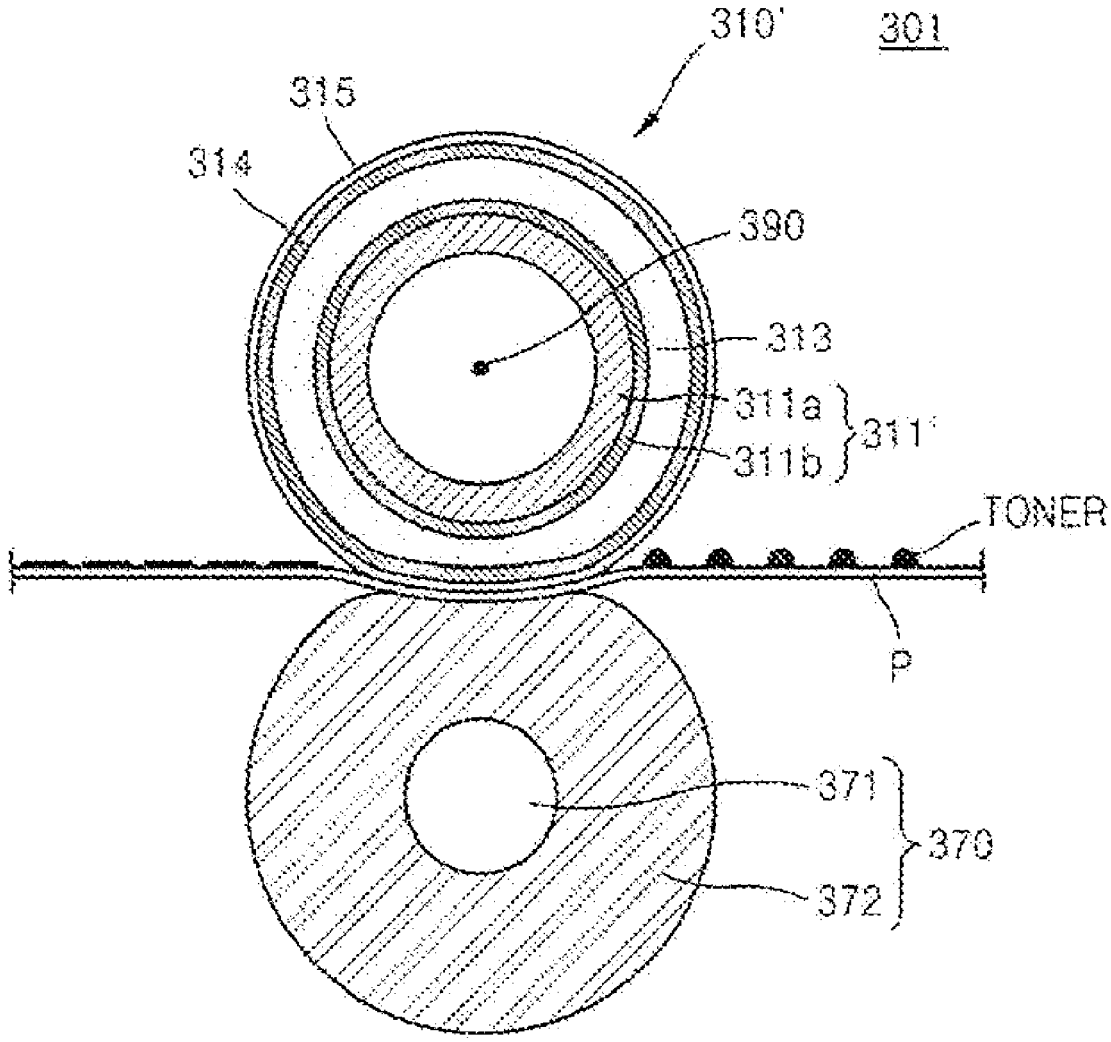
FIG. 6 is a cross-sectional view of a heating member of a fusing device of an electrophotographic image forming apparatus according to another embodiment of the present disclosure.

FIG. 6 is a cross-sectional view of a heating member of a fusing device 301 according to another embodiment of the present disclosure. Referring to FIG. 6, a heating member 310' of the fusing device 301 may include a load support member 311', a resistive heating layer 313, an outer electrode layer 314 and a release layer 315. Those features of the fusing device 301 with the same reference numerals as in any of the previously described embodiments are substantially the same as previously described, the detailed description therefor is thus unnecessary, and, for brevity sake, will not be repeated.

The load support member 311' may include a non-conductive support member 311*a* and an inner electrode layer 311*b*. The non-conductive support member 311*a* may act to maintain the external appearance of the heating member 310'. The non-conductive support member 311*a* may be formed of a non-conductive material. For example, the non-conductive support member 311*a* may be formed of a highly heat-resistant plastic such as, for example, polyphenylene sulfide (PPS), polyamide-imide, polyimide, polyketone, polyphthalamide (PPA), polyether-ether-ketone (PEEK), polyethersulfone (PES), and polyetherimide (PEI). Any material that maintains the mechanical properties of the non-conductive support member 311*a* at a temperature commonly used for the fusing device 301 may be used to form the non-conductive support member 311*a*.

The inner electrode layer 311*b* may be formed on the outer circumferential surface of the non-conductive support member 311*a*. The inner electrode layer 311*b* may be formed of metal having high electrical conductivity such as, including, for example, but not limited to, Au, Al, Cu and Ni. Examples of the material that is used to form the inner electrode layer 311*b* may also include, a conductive metal oxide such as, for example, indium tin oxide (ITO) commonly used to form a transparent electrode; a conductive polymer with excellent electrical conductivity such as, for example, poly-3,4-ethylenedioxythiophene (PEDOT) and polypyrrole (PPy); a carbonaceous material such as, for example, carbon fiber, carbon nanotube, carbon nanofiber, carbon filament, carbon coil, and carbon black; and any composite material thereof.

The inner electrode layer 311*b* functions as an electrode for supplying electricity to the resistive heating layer 313 together with the outer electrode layer 314. According to an embodiment, the inner electrode layer 311*b* and the outer electrode layer 314 may each have a thickness of about 500 nm or greater so as to uniformly supply current to the entire surface of the resistive heating layer 313.

Figure 7:
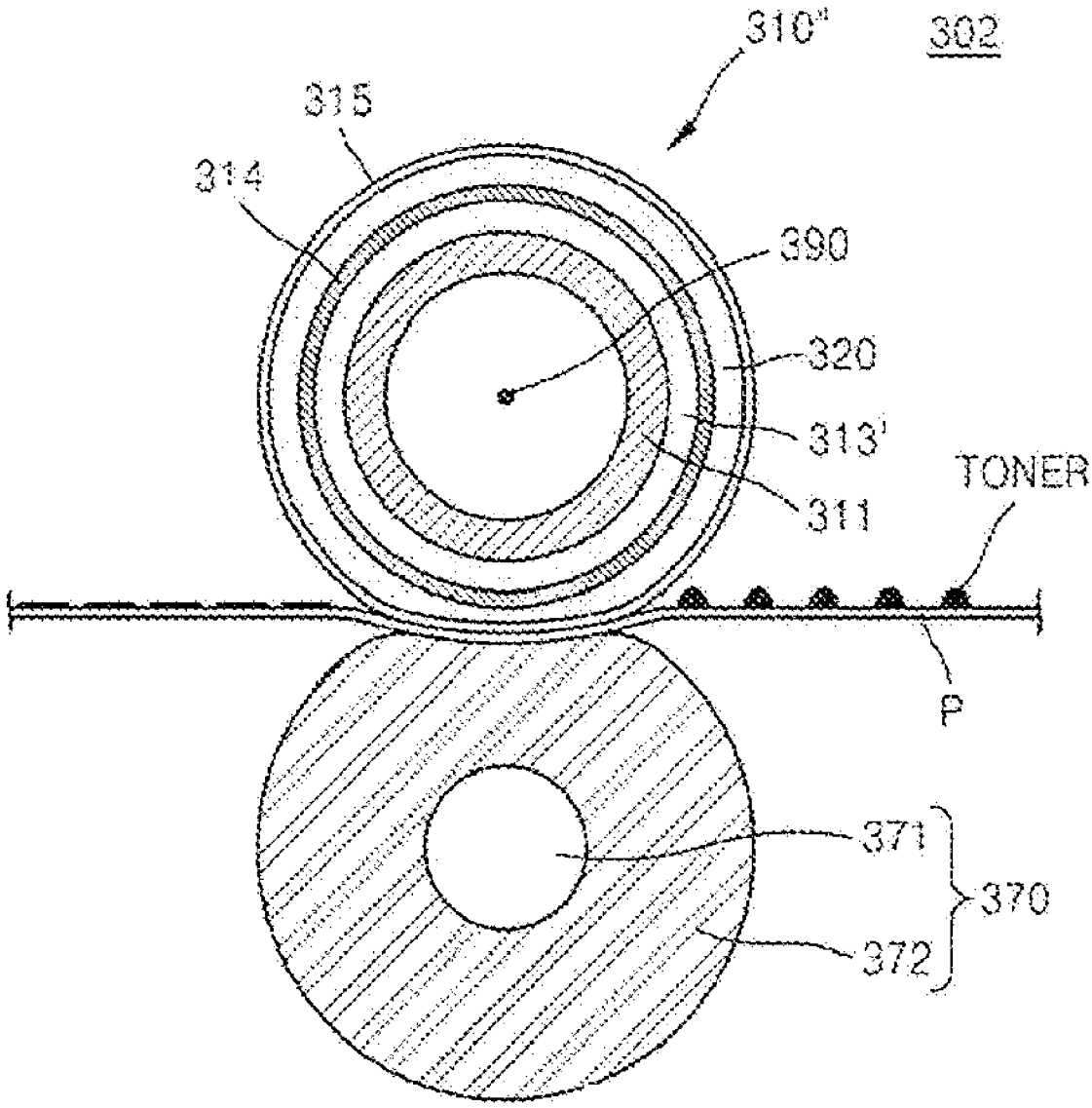
FIG. 7 is a cross-sectional view of a heating member of a fusing device of an electrophotographic image forming apparatus according to yet another embodiment of the present disclosure.

FIG. 7 is a cross-sectional view of a heating member of a fusing device according to another embodiment of the present disclosure. Referring to FIG. 7, a heating member 310" of the fusing device 302 includes a load support member 311, a resistive heating layer 313', an outer electrode layer 314, an elastic layer 320 and a release layer 315. Those features of the fusing device 302 with the same reference numerals as in any of the previously described embodiments are substantially the same as previously described, the detailed description therefor is thus unnecessary, and, for brevity sake, will not be repeated.

According to the embodiment illustrated in FIG. 7, an elastic layer 320 is interposed between the outer electrode layer 314 and the release layer 315. The elastic layer 320 may be formed of elastomer such as silicon rubber, for example, polydimethylsiloxane (PDMS). With the addition of the elastic layer 320, the base material for the resistive heating layer 313' may not be required to have significant elasticity, and thus any material having sufficient heat-resistance to endure a fusing temperature may be used without limitation.

While in FIG. 7, the elastic layer 320 depicted as being interposed between the outer electrode layer 314 and the release layer 315, the elastic layer 320 may be provided at other locations. For example, the elastic layer 320 may alternatively be interposed between the load support member 311 and the resistive heating layer 313'. In such embodiment, an inner electrode layer (not shown) may be provided between the elastic layer 320 and the resistive heating layer 313'.

Figure 8:
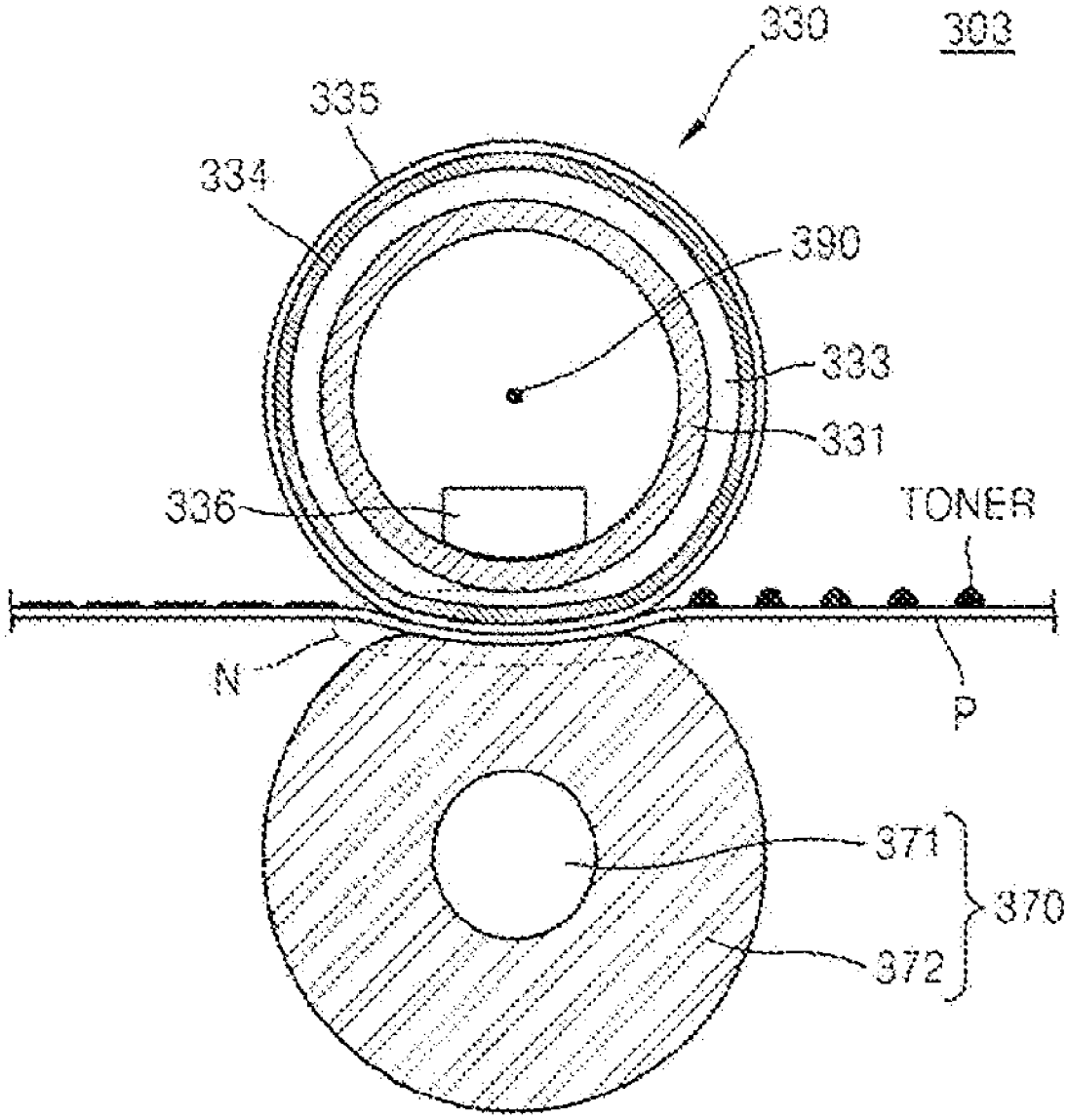
FIG. 8 is a cross-sectional view of a heating member of a fusing device of an electrophotographic image forming apparatus according to even yet another embodiment of the present disclosure.

FIG. 8 is a cross-sectional view of a heating member of a fusing device according to another embodiment of the present disclosure. Referring to FIG. 8, the fusing device 303 may include a heating member 330 having a belt shape and the pressing member 370 engaged with the heating member 330 to form the fixing nip N. A presser 336 that biases the heating member 330 toward the pressing member 370 may be disposed inside of the heating member 330. The presser 336 is merely an illustrative example of ways in which to bias the heating member 330 toward the pressing member 370, and should not be construed as a limitation of the scope of the present disclosure.

The heating member 330 includes a load support member 331, a resistive heating layer 333 formed on the outer circumferential surface of the load support member 331, an electrode layer 334 formed on the outer circumferential surface of the resistive heating layer 333 and a release layer 335 formed on the outer circumferential surface of the electrode layer 334. Due to the belt shape of the heating member 330, the heat capacity of the heating member 330 may be reduced, making a near instant heating possible.

The load support member 331 may be the substrate belt of the heating member 330. The load support member 331 may be a conductive metal thin film formed of, for example, iron (Fe), steel, stainless steel, aluminum (Al), copper (Cu), or the like. The load support member 331 that has sufficiently high conductivity may function as an inner electrode for the resistive heating layer 333.

The resistive heating layer 333 may be fabricated by dispersing a conductive filler in a base material, and may be substantially the same as the resistive heating layer 313 described with reference to FIGS. 2 to 6. For example, a highly heat-resistant elastomer such as silicon rubber, for example, polydimethyl siloxane (PDMS), may be used as the base material. The conductive filler may be a metallic filler such as, for example, iron (Fe), nickel (Ni), aluminum (Al), gold (Au) and silver (Ag), and/or a carbonaceous filler such as, for example, carbon black, single carbon fiber, carbon filament and carbon coil. Current flows in a direction perpendicular to the resistive heating layer 333 by applying a voltage to the inner circumferential surface and the outer circumferential surface of the resistive heating layer 333.

The electrode layer 334 may function as the outer electrode for the resistive heating layer 333, and may be formed of highly conductive metal such as, for example, Au, Al, Cu, and Ni; a conductive metal oxide such as, for example, indium tin oxide (ITO); a conductive polymer with excellent electrical conductivity such as, for example, poly-3,4-ethylenedioxythiophene (PEDOT) and polypyrrole (PPy); a carbonaceous material such as, for example, carbon fiber, carbon nanotube, carbon nanofiber, carbon filament, carbon coil, and carbon black; and any composite material thereof. According to an embodiment, the electrode layer 334 may have a thickness of 500 nm or greater so that electricity is uniformly supplied to the entire outer circumferential surface of the resistive heating layer 333.

The release layer 335 is the outermost layer of the heating member 330 and may be formed of a fluoropolymer such as PFA and FEP, for example. The release layer 335 may not be necessary in some embodiments, and thus may be omitted in such embodiments.

Figure 9:
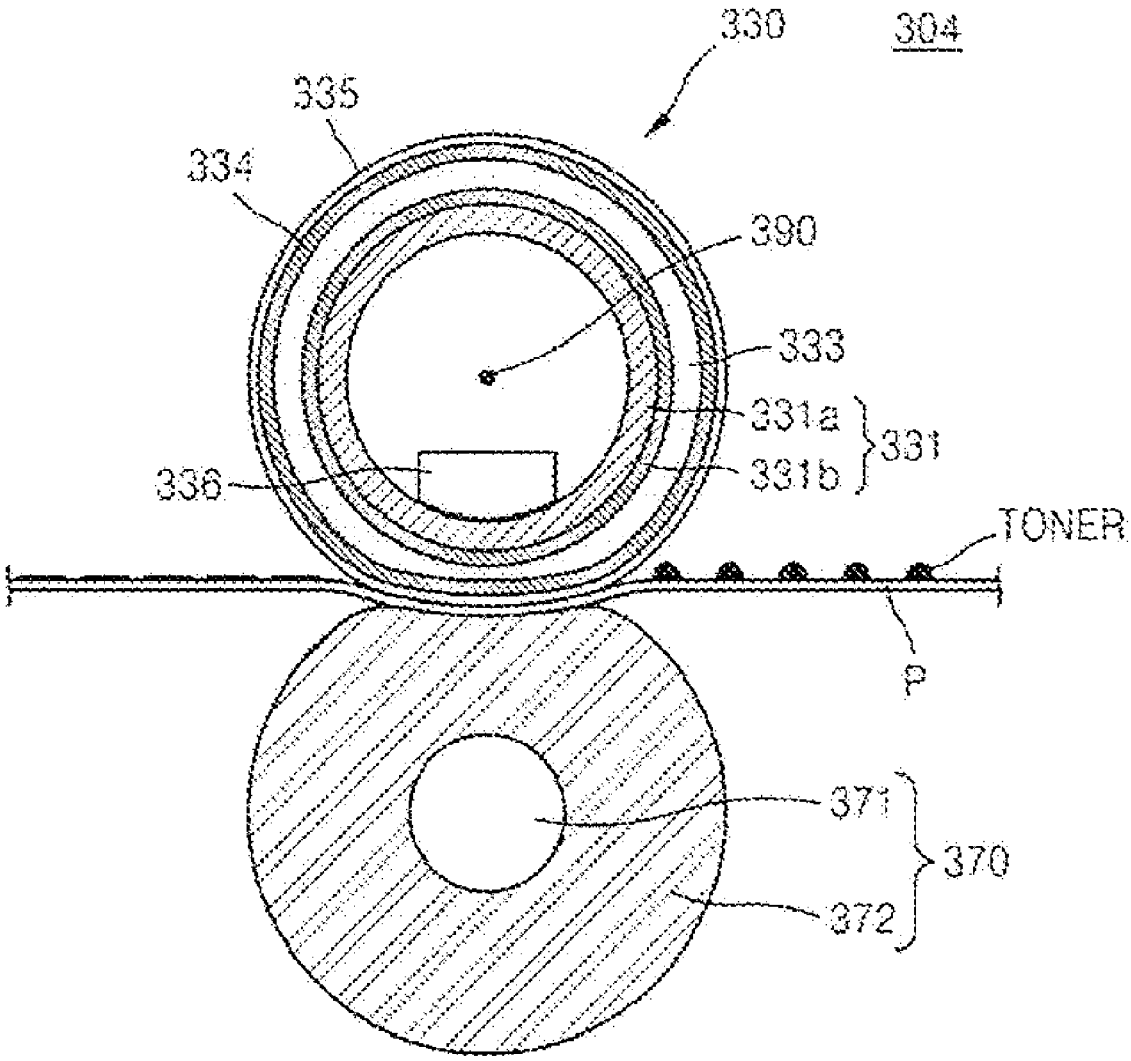
FIG. 9 is a cross-sectional view of a heating member of a fusing device of an electrophotographic image forming apparatus according to another embodiment of the present disclosure.

FIG. 9 is a cross-sectional view of a heating member of a fusing device according to another embodiment of the present disclosure. Referring to FIG. 9, a heating member 330' of the fusing device 304 may include a load support member 331', a resistive heating layer 333, an outer electrode layer 334 and a release layer 335. Those other components, other than the load support member 331', that are designated with the same reference numerals are substantially the same as those of the previous embodiments described with reference to FIG. 8, the detailed descriptions thereof will thus not be repeated.

The load support member 331' may include a non-conductive support member 331*a* and an inner electrode layer 331*b*. The non-conductive support member 331*a* may act to maintain the external appearance of the heating member 330'. The non-conductive support member 331*a* may be formed of a non-conductive material. For example, the non-conductive support member 331*a* may be formed of a highly heat-resistant plastic having excellent mechanical properties at high temperature such as, for example, polyphenylene sulfide (PPS), polyamide-imide, polyimide, polyketone, polyphthalamide (PPA), polyether-ether-ketone (PEEK), polyethersulfone (PES), and polyetherimide (PEI).

The inner electrode layer 331*b* may be formed on the outer circumferential surface of the non-conductive support member 331*a*, and may be formed of a highly conductive metal such as, for example, Au, Al, Cu and Ni; a conductive metal oxide such as, for example, indium tin oxide (ITO); a conductive polymer with excellent electrical conductivity such as, for example, poly-3,4-ethylenedioxythiophene (PEDOT) and polypyrrole (PPy); a carbonaceous material such as, for example, carbon fiber, carbon nanotube, carbon nanofiber, carbon filament, carbon coil, and carbon black; and any composite material thereof. According to an embodiment, the inner electrode layer 331*b* and the outer electrode layer 334 may each have a thickness of 500 nm or greater so as to uniformly supply current to the entire surface of the resistive heating layer 333.

Figure 10:
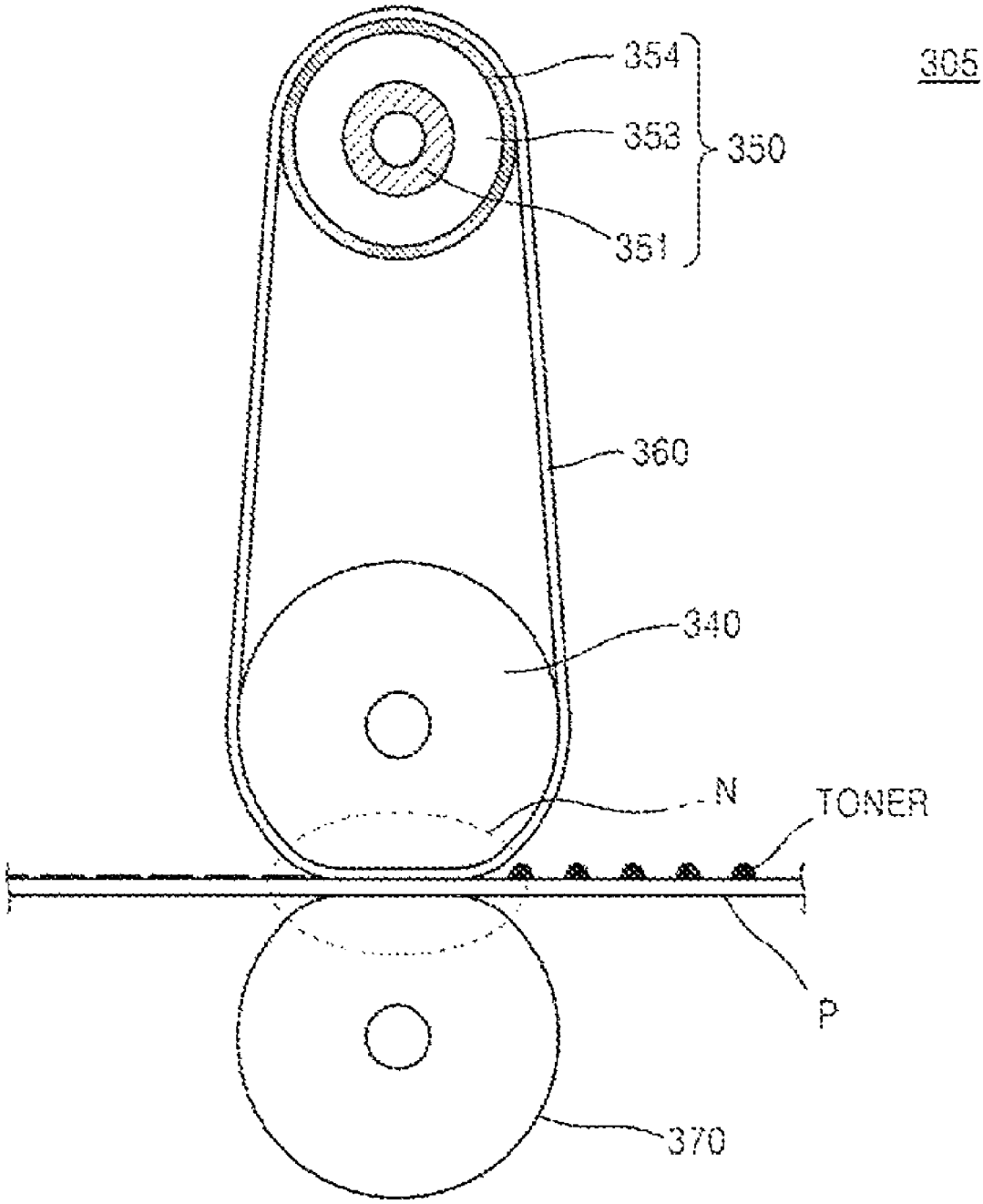
FIG. 10 is a longitudinal sectional view of a heating member of a fusing device of an electrophotographic image forming apparatus according to another embodiment of the present disclosure.

FIG. 10 is a cross-sectional view of a heating member of a fusing device according to another embodiment of the present disclosure. Referring to FIG. 10, the fusing device 305 may include the pressing member 370, a nip forming member 340 engaged with the pressing member 370 to form the fixing nip N, a heating member 350 for producing heat and a fixing belt 360 forming a closed loop around the nip forming member 340 and the heating member 350 interposed therebetween. The pressing member 370 may be located outside the fixing belt 360. To form the fixing nip N, the nip forming member 340 and the pressing member 370 may be rotated while being engaged with each other with the fixing belt 360 interposed therebetween. An elastic bias unit (not shown) may be provided to exert an elastic force to the nip forming member 340 and/or the pressing roller 370 in directions in which the nip forming member 340 and the pressing roller 370 are in a pressing contact with each other. The nip forming member 340 may be an elastic roller, and may have a substantially same structure as the pressing member 370.

The heating member 350 may include a load support member 351, a resistive heating layer 353 formed on the outer circumference of the load support member 351 and an electrode layer 354 for supplying electricity to the resistive heating layer 353. The load support member 351 may act to maintain the external appearance of the heating member 350, and may also serve as the rotation axis of the heating member 350. The load support member 351 may be formed of a conductive material so as to also function as the inner electrode for the resistive heating layer 353. For example, the load support member 351 may be a metal pipe formed of, for example, Fe, steel, stainless steel, Al, Cu, or the like. The resistive heating layer 353 may be prepared by dispersing a conductive filler in a base material such as, for example, PDMS. The conductive filler may be a metallic filler and/or a carbonaceous filter as previously described above. The electrode layer 354 may be formed around the outer circumferential surface of the resistive heating layer 353 to supply electricity to the resistive heating layer 353, and may have a thickness of 500 nm or greater. The electrode layer 354 may be formed of highly conductive metal, a conductive polymer, a carbonaceous material, or any composite material thereof.

The fixing belt 360 may be formed of a thin film of metal such as, for example, stainless steel or a non-metallic material such as, for example, polyimide. The thickness of the fixing belt 360 may be determined such that the fixing belt 360 may flexibly deform at the fixing nip N and return to its original shape after passing through the fixing nip N. A release layer (not shown) may further be formed on the outer circumferential surface of the fixing belt 360. The fixing belt 360 may be made to maintain a close contact with the heating member 350 for efficient heat transmission by arranging around the nip forming member 340 and the heating member 350 so as to provide a sufficient tension in the fixing belt 360.

FIGS. 11A to 11E are views illustrating a method of fabricating a heating member according to an embodiment of the present disclosure.

Figure 11A:
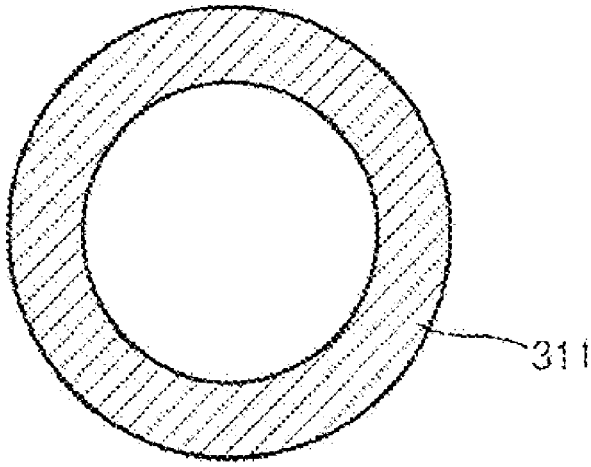
FIGS. 11A to 11E are views illustrating a method of fabricating a heating member according to an embodiment of the present disclosure.
Figure 11B:
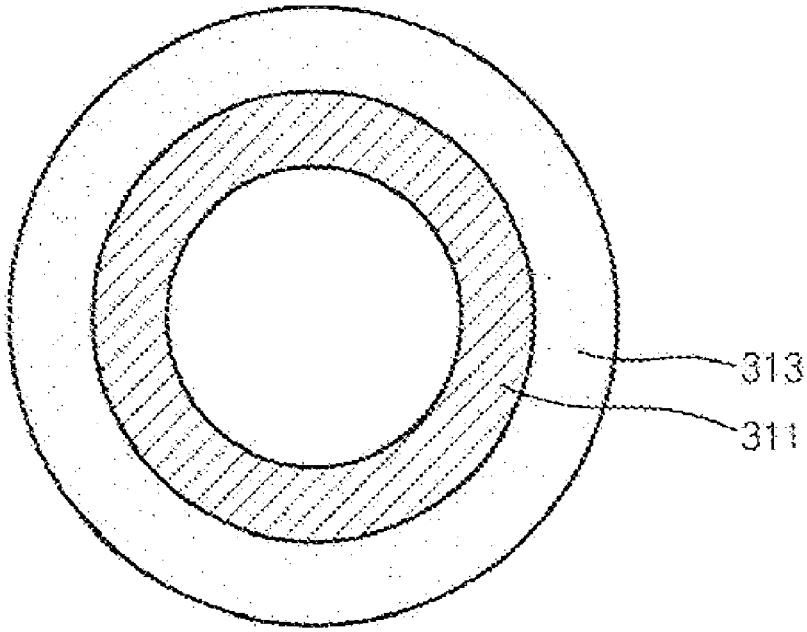

As shown in FIG. 11A, a metallic pipe as the load support member 311 is prepared. Then, the resistive heating layer 313 is coated to a predetermined thickness on the outer circumferential surface of the load support member 311 as shown in FIG. 11B. As described with reference to FIG. 5, a part of the load support member 311 may be exposed for electrical connection when the resistive heating layer 313 is formed.

Figure 11C:
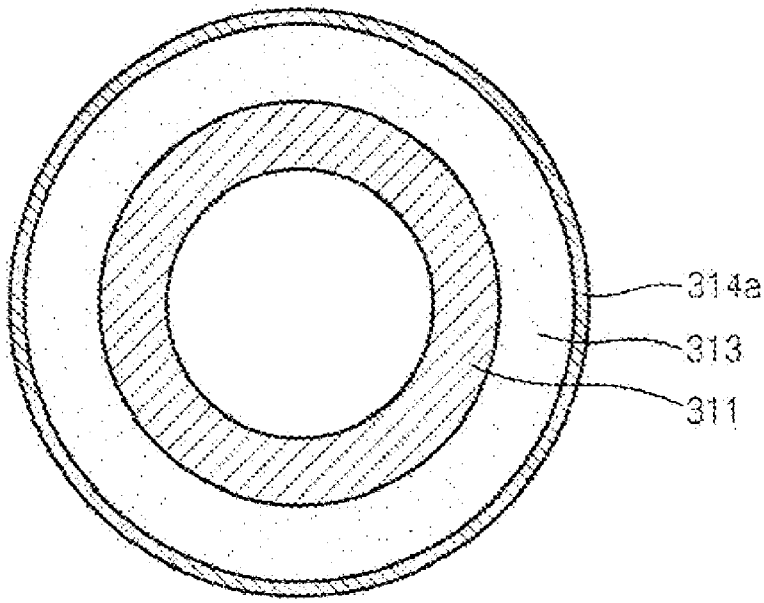
Figure 11D:
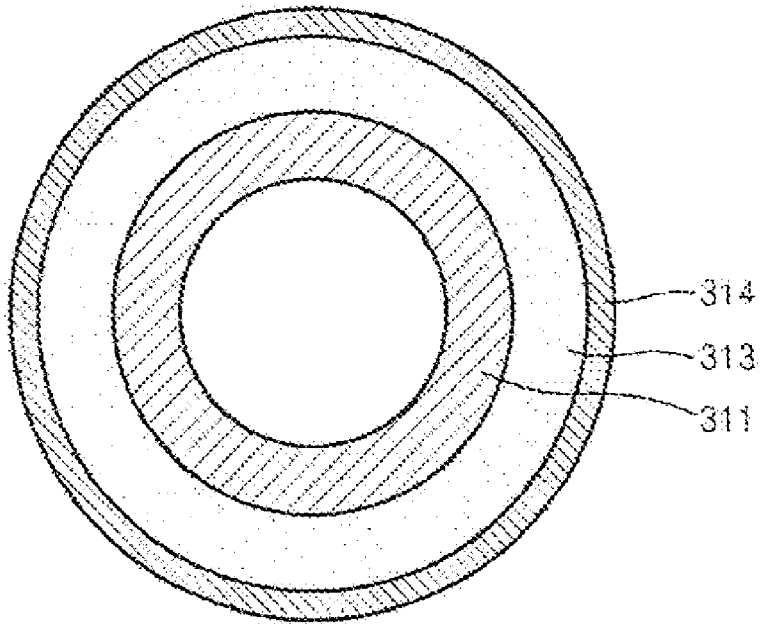

Then, a seed layer 314*a* is formed on the outer circumferential surface of the resistive heating layer 313 as shown in FIG. 11C. The seed layer 314*a* may be formed by depositing, for example by sputtering, conductive metal. Then, an electrode layer 314 may be formed by electroplating using the seed layer 314*a* as shown in FIG. 11D. The electrode layer 314 may be formed, for example, by electroless plating using the seed layer 314*a* as a catalyst. By forming the seed layer 314*a* on the outer circumferential surface of the resistive heating layer 313 first, the electrode layer 314 may be formed uniformly with sufficient uniformity in the contact between the resistive heating layer 313 and the electrode layer 314.

Figure 11E:
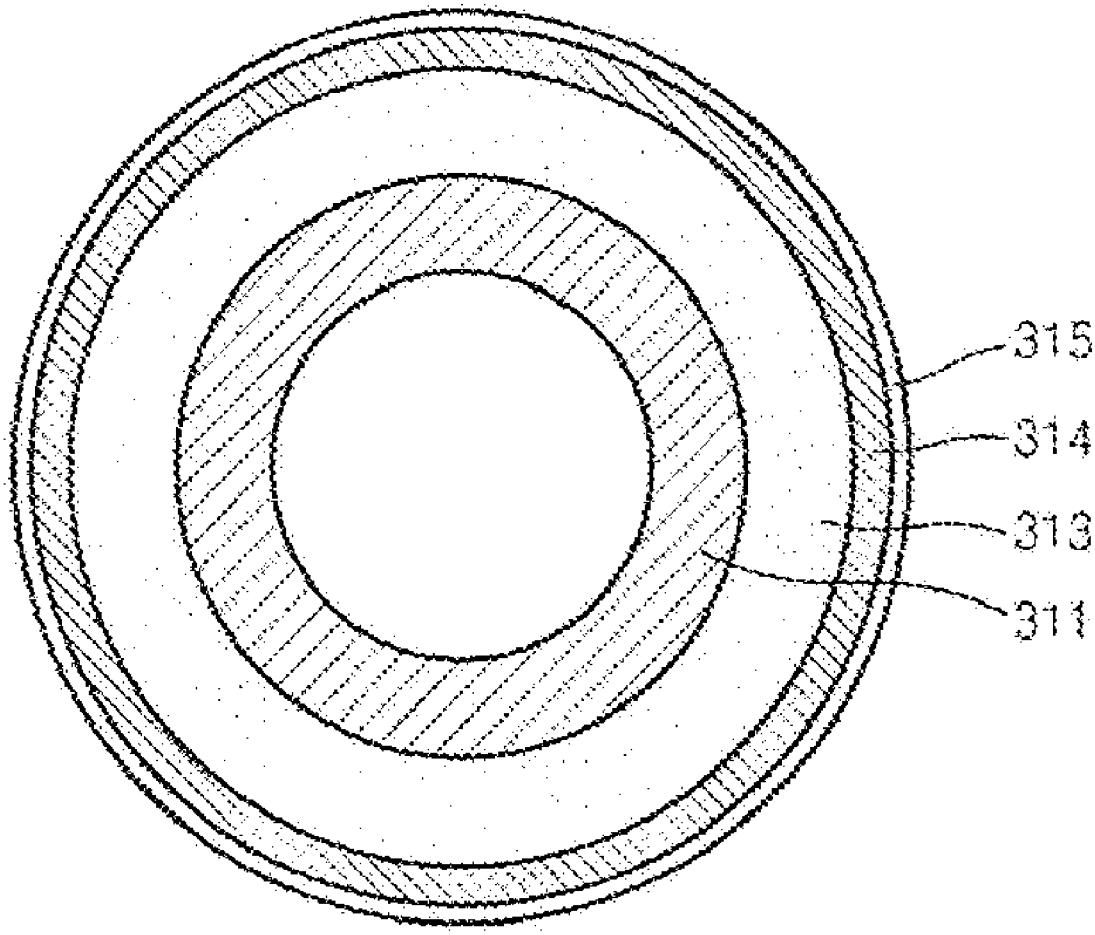

Then, the release layer 315 may be coated on the outer circumferential surface of the electrode layer 314 as shown in FIG. 11E. As described with reference to FIG. 5, a part of the outer circumferential surface of the electrode layer 314 may be exposed for electrical connection when the release layer 314 is formed.

As described above, according to the one or more of the above embodiments of the present disclosure, an electrical resistance required for a resistive heating layer may be reduced by allowing electrical current to flow in a radial direction of the resistive heating layer, thus shortening the path of the current. Thus, a heating member and a fusing device according to one or more embodiments of the present disclosure may be heated more efficiently and quickly. Furthermore, according to aspects of the present disclosure, the heating member and the fusing device may be ensured to exhibit mechanical properties suitable for use as the use of a large the amount of conductive filler in the resistive heating layer may be unnecessary.

While the present disclosure has been particularly shown and described with reference to several embodiments thereof, it will be understood by those of ordinary skill in the art that various changes in form and details may be made to those embodiments described herein without departing from the spirit and scope of the present disclosure as defined by the following claims and their equivalents.

What is claimed is:

1. A heating member, comprising:

a non-conductive load support member having an outer circumferential surface that is conductive;

a resistive heating layer formed on the outer circumferential surface of the load support member, the resistive heating layer being capable of producing heat in response to a conduction of electricity therethrough; and an outer electrode layer formed on an outer circumferential surface of the resistive heating layer, wherein, when the electricity is supplied through the load support member and the outer electrode layer, the electricity flows in the resistive heating layer in a radial direction thereof.

2. The heating member of claim 1, wherein the load support member comprises an inner electrode layer formed on an outer circumferential surface of the non-conductive support member, the non-conductive support member being formed of a non-conductive material, the inner electrode layer being formed of conductive material.

3. The heating member of claim 2, wherein the inner electrode layer comprises at least one selected from the group consisting of a metal, a conductive metal oxide, a conductive polymer and a conductive carbonaceous material.

4. The heating member of claim 2, wherein the inner electrode layer has a thickness of 500 nm or greater.

5. The heating member of claim 1, wherein the resistive heating layer comprises a base material and a conductive filler dispersed in the base material.

6. The heating member of claim 5, wherein the base material comprises an elastic material.

7. The heating member of claim 6, wherein the elastic material comprises silicon rubber.

8. The heating member of claim 6, wherein the amount of conductive filler dispersed in the based material is 20 wt % or less.

9. The heating member of claim 6, wherein the conductive filler comprises at least one of a metallic filler and a carbonaceous filler.

10. The heating member of claim 1, wherein the outer electrode layer comprises at least one selected from the group consisting of a metal, a conductive metal oxide, a conductive polymer and a conductive carbonaceous material.

11. The heating member of claim 1, wherein the outer electrode layer has a thickness of 500 nm or greater.

12. The heating member of claim 1, further comprising an elastic layer interposed between the outer electrode layer and an outermost layer of the heating member or between the load support member and the resistive heating layer.

13. The heating member of claim 1, further comprising a release layer formed on an outer circumferential surface of the outer electrode layer.

14. A fusing device for fusing toner onto a print medium by application of heat and pressure on the print medium, comprising:

a heating member for producing heat; and a press member in a pressing contact with the heating member so as to form a fixing nip with the heating member, wherein the heating member comprises:

a non-conductive load support member having an outer circumferential surface that is conductive;

a resistive heating layer formed on the outer circumferential surface of the load support member, the resistive heating layer being capable of producing heat in response to a conduction of electricity therethrough; and an outer electrode layer formed on an outer circumferential surface of the resistive heating layer, and wherein, when the electricity is supplied through the load support member and the outer electrode layer, the electricity conducts in the resistive heating layer in a direction perpendicular to the resistive heating layer.

15. The fusing device of claim 14, wherein the heating member has a roller shape.

16. The fusing device of claim 14, wherein the heating member has a belt shape.

17. The fusing device of claim 16, further comprising a pressing member disposed inside the heating member, the pressing member pressing at least a portion of the heating member toward the press member.

18. A fusing device for fusing toner onto a print medium by application of heat and pressure on the print medium, comprising:

a heating member for producing heat;

a nip forming member arranged to be spaced apart from the heating member;

a fixing belt forming a closed loop around, and in contact with each of, the heating member and the nip forming member so as to convey the heat produced by the heating member to the nip forming member; and a pressing member opposingly facing the nip forming member with the fixing belt interposed between the nip forming member and the pressing member, the pressing member pressing the fixing belt against the nip forming member so as to cause a fixing nip to be formed between the nip forming member and the fixing belt, wherein the heating member comprises:

a load support member having an outer circumferential surface that is conductive;

a resistive heating layer formed on the outer circumferential surface of the load support member, the resistive heating layer being capable of producing heat in response to a conduction of electricity therethrough; and an outer electrode layer formed on an outer circumferential surface of the resistive heating layer, and wherein, when the electricity is supplied through the load support member and the outer electrode layer, the electricity conducts in the resistive heating layer in a direction perpendicular to the resistive heating layer.

19. The fusing device of claim 18, wherein the resistive heating layer comprises a base material and a conductive filler dispersed in the base material, and wherein the amount of conductive filler dispersed in the based material is 20 wt % or less.

20. The fusing device of claim 18, wherein the outer electrode layer has a thickness of 500 nm or greater.

* * * * *